US005746149A

United States Patent [19]

Molz

[11] Patent Number: 5,746,149

[45] Date of Patent: May 5, 1998

[54] DOCKING APPARATUS

[76] Inventor: Herbert F. Molz, 1000 N. U.S. Highway 1, Unit 761, Jupiter, Fla. 33477

[21] Appl. No.: 831,728

[22] Filed: Apr. 1, 1997

[51] Int. Cl.[6] ..... B63B 21/00

[52] U.S. Cl. ..... 114/230

[58] Field of Search ..... 114/230, 293, 114/294; 441/3–5; 242/438.1

[56] References Cited

U.S. PATENT DOCUMENTS

| | | | |
|---|---|---|---|
| 3,300,187 | 1/1967 | Saxe et al. | 114/230 |
| 3,422,783 | 1/1969 | Moulin | 114/230 |
| 3,666,190 | 5/1972 | Dykmans | 242/438.1 |
| 4,200,052 | 4/1980 | Cunningham et al. | 114/230 |
| 5,365,872 | 11/1994 | Obrinski | 114/230 |

*Primary Examiner*—Stephen Avila
*Attorney, Agent, or Firm*—McHale & Slavin

[57] ABSTRACT

A docking system employing at least two hydraulic line retrieval devices operated by a centralized hydraulic system. The retrieval systems allows for free wheeling line deployment and variable speed line retraction. Solenoid valves are used to allow and operator to draw one line faster than the another thereby allowing the vessel to be moved fore or aft to assure proper alignment. The lines employed are smaller than mooring lines allowing for compact housing structures. The housing structures retrieve the lines through an aperture wherein an end cap located on the end of the line seals the aperture. The end cap is weighted providing a line that can be thrown a long distance.

17 Claims, 3 Drawing Sheets

DOCKING APPARATUS

FIELD OF THE INVENTION

This invention relates to the marine industry and in particular to a docking apparatus for yachts allowing the captain of the boat to control the dock lines from the bridge.

BACKGROUND OF THE INVENTION

The maneuvering of a boat can be most difficult should conditions exist that have an adverse effect on the operation of the vessel. For instance, most larger boats and yachts have difficulty maneuvering in confined areas due to their size and shape. Current hull designs and interior accommodations have dictated the width of such vessels leaving minimal water displacement. This large freeboard complicates the maneuvering in confined areas for if a wind is present, the vessel can be easily moved as if the vessel sidewalls operate as a sail.

In addition, many vessel manufacturers have eliminated the side walk on a vessel requiring docking and mooring functions to be performed through an open window. The elimination of the walkway increases the living space of the cabin but makes it most dangerous for the crew member to assist during the docking procedure. Further, many manufacturers provide partial walkways requiring a crew member to walk through the cabin or pilot house in order to reach the partial walkway.

Close quarter maneuvering is required when a vessel is in the process of docking either for a temporary stay or setting up for an extended stay. If the vessel is too difficult to handle, the owner may avoid use of the vessel for fear of being placed in a confined area. This can quickly defeat the benefit of owning a vessel wherein the owner may take a late evening cruise and stop for dinner along the way. If docking is difficult, the owner may also require additional assistance, i.e. crew members, for the docking maneuver. For instance, a 60-foot yacht has a long distance between the bow and the stern requiring an individual to be positioned at both locations in order to handle a docking line during the docking process. When the vessel is maneuvered along a pier for purposes of docking the boat, the operator typically utilizes dual engines and water directional skills in order to position the boat against the pier. If the vessel has multiple engines one engine may be reversed while the other rotated forwardly which may cause rotation to the vessel for positioning the bow near the pier wherein a crew member can either hand a line to an individual on the pier or place a line around a pile. The operator may then use a cleated line to permit rotation of the stern of the boat for positioning against the pier.

In many instances the lines used by a vessel for docking are unnecessarily large and bulky. Typically, the lines kept on a vessel are to maintain the vessel in position during high winds. However, such lines are not necessary if the vessel is to be docked temporarily such as when the occupants stops for food, fuel, or even an overnight stay in calm weather. The use of the heavy lines for such a procedure adds to the burden of docking. In addition, whenever a line is exposed, its structural integrity is compromised by chaffing and exposure to the elements.

The docking ability of the crew member to secure a line to the pier and to the vessel's holding cleat is critical. For this reason, the line that is placed on the pier typically includes an enlarged loop sized to encompass a pile. The crew member must then pull the vessel toward the pier and then secure the free end of the line to one of the vessel's cleats. If the deck of the vessel is slick, the crew member can be placed in a dangerous position if he attempts to pull the boat to the pier. Alternatively, the free end of the line is thrown to an individual on the pier who then pulls the vessel to the pier. Such vessels can easily weigh over 25 tons making the pull rate most difficult for those not accustomed to the maneuver. The line must then be adjusted a safe distance in respect to the pier and in relation to the stern of the boat.

The cleating process is also important as an improperly tied line to a cleat can become unwrapped allowing the vessel to drift if the line becomes loose. Also, if the line is not properly tied to the cleat, yet another dangerous situation occurs should the vessel have to clear of the pier quickly due to current and/or wind. For example, if one line is removed from a cleat and a second line was improperly tied, the failure to immediately untie the second line may put the vessel in a precarious position. Should the vessel drift or be moved away from the pier, the pressure onto the improperly tied line makes it more difficult for removal causing a tethering of the vessel to the pier. The tethering exposes the vessel to the wind or current causing a control problem that may lead to property damage.

Another problem with the current docking procedures is the need for readjusting of lines so as to allow for entrance and exit to the vessel in such an area that facilitates occupant safety. For instance, a number of vessels have steps leading out of the cockpit for use in ingress and egress of the vessel. The steps may be located next to a hand rail and should a pile be placed directly in front of the pile, the entrance will be blocked. If the tide changes the vessel may also be moved into a position to cause blockage. For this reason, crew members must either loosen or tighten the lines with corresponding adjustments in order to properly position the vessel in relation to the pier.

U.S. Pat. No. 5,365,872 discloses a remote controlled mooring system. This invention requires sizing lines capable of mooring a vessel making the structure cumbersome for any sized boat. The device is a mooring system, not a docking system. In addition, the invention is directed to a cleat release device that is expensive to manufacture and not capable of withstanding a seawater environment. Further, the cleat attachment positioned on the end of the line is metal, or coated metal, and the retrieval of the line will cause the cleat attachment to either fall into the water or impact the hull of the vessel.

Thus, what is lacking in the art is a docking apparatus and method thereof that allows the operators of larger vessels, in particular those vessels between 40 foot and 120 foot, to facilitate docking wherein only the operator need be qualified in operation of the vessel allowing an untrained crew member to be used for assistance in the safe docking of the vessel. Also what is needed is the ability to maneuver the vessel once in a docked positioned in order to position the vessel for optimum entrance and exiting.

SUMMARY OF THE INVENTION

The instant invention is a docking system comprising a combination of line retrieval devices located on either side of a vessel, bow and stern of a vessel, or a combination thereof. Each line retrieval device includes provisions for freewheeling of a line which allows an inexperienced crew member to assist in placement of the lines while the operator of the vessel is able to stay on the bridge and manipulate the lines as needed. For instance, if a vessel is to be placed port side along a pier, once two lines on the port side have been deployed by placement over a pile or pier cleat, the operator of the vessel can control the retraction of the lines. The line retrieval devices provide freewheeling deployment from a control system located on the bridge or bridges.

The line retrieval devices of the instant invention are winches that are individually housed and preferably hydraulically actuated by a central pump and valve manifold. The winches may be independently or simultaneously actuated and controlled by a single bridge located control station, a remote control station, or from multiple stations. The remote control station would allow the operator of the vessel to look over the side wall of the vessel while retracting the lines. A multiple station is made possible by having receptacles located on the port and starboard side wall wherein the operator can attach the controller to the appropriate receptacle allowing the operator to be positioned in the most strategic position.

The hydraulic line operation allows the use of a free wheeling spool for quick line deployment and variable speed line retractions. Additionally, the operator of the vessel is able to draw one line faster than the other thereby allowing the vessel to be moved fore or aft to assure proper alignment for entering or exiting of the vessel. The use of a hydraulic pump allows compact line retrieval holders to be positioned in a number of locations along the side of the vessel. In addition, the line size used for docking may be smaller than that used for actual mooring further allowing compactness. Alternatively, the line size can be increased allowing the device to operate for purposes of mooring.

The line retrieval devices may be placed on the bulwark, behind a weather board, on the cap rail, in place of a cleat, with a cleat incorporated into the device, and so forth. The side walls of the vessel may include an opening for a line leading into the spool holder, this may be incorporated during construction or mounted with minimal sidewall reinforcement. In this embodiment, the line may include a monkey fist or weighted end cover that attaches to the loop end of a line. This end cover operates to seal the line within the line retrieval device while in a storage position. The line cover is preferably constructed of a white rubber that does not mar fiberglass or paint should it impact the side of the vessel during retraction. In addition, the end cover provides a weight allowing the line to be tossed. In this manner, a crew member is able to toss or swing the end over a long distance eliminating the need for positioning the vessel next to the pier in order to hand a line to an individual on the pier.

Thus, a primary object of the instant invention is to provide a docking apparatus that allows the operator of the vessel to control the docking maneuvers from the bridge of a vessel, the docking apparatus allowing for the temporary securement of a vessel to a dock for short stays or until mooring lines are positioned.

Another object of the instant invention is to teach a docking apparatus that allows the use of smaller lines for purposes of docking a vessel under most conditions thereby making line handling less difficult and allowing for compact storage of the lines.

Another object of the instant invention is to teach a docking apparatus that lessens the need for trained crew members in order to handle lines during a docking procedure.

Yet another object of the instant invention is to teach a docking apparatus that replaces conventional line handling techniques by disclosing a line retrieval device allowing the operator of the vessel to maneuver the vessel into position without further assistance from other individuals.

Another object of the instant invention is to teach the use of a dock handling device that conceals lines upon retrieval.

Yet another object of the instant invention is to teach the use of a weighted end cap that facilitates tossing of a line and operates to cover the line opening of the retrieval apparatus.

Still another object of the instant invention is to teach a docking apparatus that allows for variable speed control of the docking lines by permitting free wheeling of the line spool upon deployment and variable speed upon retraction.

Yet still another object of the instant invention is to teach a docking apparatus that can be used in combination with a boat cleat.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
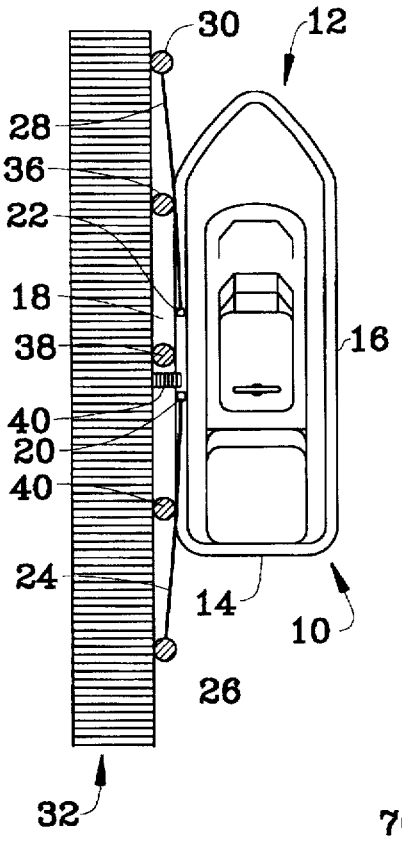
FIG. 1 is a pictorial view of the docking apparatus of the instant invention placed along a port side position fore and aft of a vessel.

Now referring to FIG. 1, vessel 10 is illustrated and defined by a bow 12, stern 14, starboard side 16 and port side 18. The vessel 10 illustrates the place of a first embodiment of the docking apparatus of the instant invention wherein line retrievable device 20 is positioned on the aft section of the port side 18 of the vessel with a second line retrieval device 22 located on the forward portion of the port side 18, to be described in more detail later in this specification.

The line retrieval device 20 utilizes line 24 having a proximal end coupled to a spool placed within a housing structure with a distal end that is readily removed from the housing structure upon release of the spool. The line 24 is placed over pile 26 and is then available to be drawn into the housing as necessary. The line 24 includes a predefined loop on the distal end of the line allowing for easy attachment to pile 26 or a pier mounted cleat. Similarly line retrieval device 22 employs line 28 having a proximal end secured to a spool within the housing structure of the device. The distal end of the line 28 also includes a predefined loop which is available for placement around pile 30. The spools are preferably hydraulic based allowing free wheeling deployment upon release of the hydraulic fluid.

Once the lines are placed around the pile, the operator or "captain" of the vessel 10 may then engage the line retrieval devices 20 and 22 causing retrieval of the lines 28 and 24 to draw the vessel 10 along side pier 32. The ability to control the speed and operation of each line retrieval device will allow the operator to position the vessel in the most appropriate position for ease of entering and exiting of the vessel. For instance, pier 32 includes pilings 36, 38 and 40 shown along the port side of the vessel. The operator has positioned the vessel 10 to position pilings 36 and 40 for support of the vessel. The positioning against pile 38 further allows for placement of entrance ladder 40 for safely coupling the walkway of the vessel to the pier.

Line retrieval device 20 allows the operator to move the vessel rearward while line retrieval device 22 allows movement of the vessel forward. The apparatus allows for instant adjustment of the lines should a tidal change occur the need for minute adjustment exist. This eliminates the need for an individual to manually adjust the line and keeps the individual out of the elements such as rain. Once the vessel is docked, the vessel can then be fueled, boarded or otherwise serviced without the need for additional lines. If the docking is extended, the vessel is in proper position to be tendered to the pier in a more permanent attachment through use of mooring lines. This procedure is simplified by placement of the vessel in the preferred docking position before the use of heavy mooring lines. It should be noted that the line retrieval devices may be located on the starboard side in place of, or in addition to, the port side placement. It is further noted that the majority of the vessels dictate entrance and exit along the starboard side and the figure is for purposes of illustration only.

Figure 2:
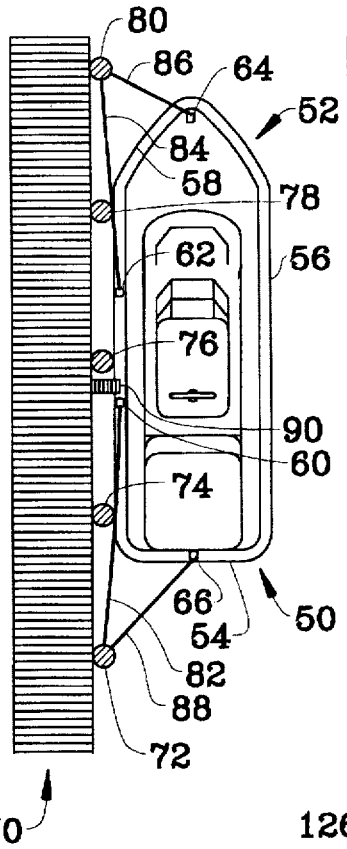
FIG. 2 is a pictorial view of the docking apparatus placed in a fore and aft port position as well as locations at the bow and stern of the vessel.

Referring now to FIG. 2, illustrated is vessel 50 defined by bow section 52, stern 54, starboard side 56, and port side 58. In this embodiment a line retrieval device 60 is located on the aft section of the port side 58 with line retrieval device 62 located on the forward portion of the port side 58. The line retrieval devices may be positioned adjacent to a cleat or be used as a replacement thereto. As will be shown later in this specification, when the line retrieval device is used as a replacement cleat, the cleat is integrated into the line retrieval structure eliminating the need for additional deck space. This embodiment further includes a line retrieval apparatus 64 located on the bow of the vessel and a stern line retrieval device 66 centrally disposed along the stern section 54 of the vessel. The addition of the bow and stern line retrieval devices allow for the temporary docking of the vessel in higher winds and current. The additional lines allow the docking of the vessel for temporary periods where the heavier mooring lines are not required. For instance, if the vessel is left unattended while the occupants are in a restaurant, the need for additional lines is unnecessary.

In this embodiment, the vessel 50 is pulled along side pier 70 having pilings 72, 74, 76, 78 and 80. Line retrieval apparatus 60 employs a light line 82 for securement to pile 72 providing a spring line operation and allowing the operator to again position the vessel in the appropriate location in relation to pile 74. The forward spring line retrieval apparatus 62 employs line 84 for placement around pile 80 providing the operator with the ability to pull the vessel forward as necessary. The retrieval apparatus 64 employs line 86 for securement to pile 80 and line retrieve apparatus 66 employs line 88 for coupling to pile 72. The lines maintain the bow and stern in the appropriate position against pier 70. The walkway 90 may then be properly positioned for placement along side pile 76 for use and entrance and exiting of the vessel. Unique to these embodiments is the ability of the docking apparatus to employ light lines for purposes of docking. This allows for compact spool housings and ease of line handling.

Figure 3:
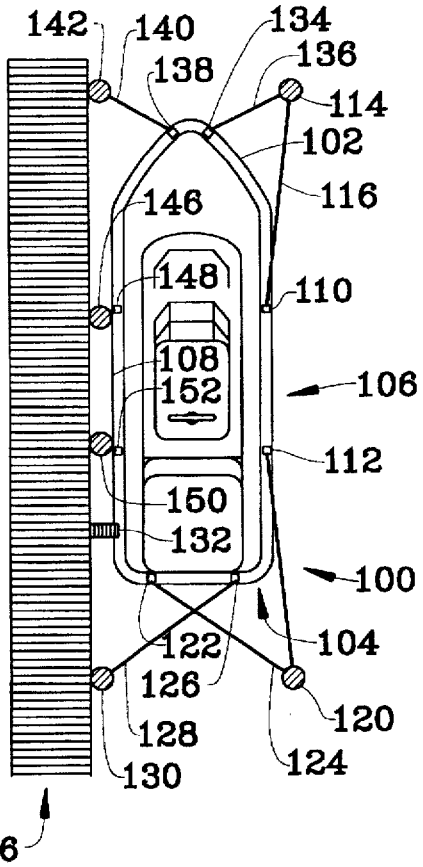
FIG. 3 illustrates the docking apparatus located at each of the key locations of the vessel.

Referring now to FIG. 3 set forth is yet another embodiment of the instant invention utilizing multiple positions on a vessel for support. In this embodiment, vessel 100 is defined by a bow 102, stern 104, starboard side 106 and port side 108. Line retrieval devices are located along the starboard side 106 as depicted by numerals 110 and 112, the port side as depicted by numerals 148 and 150, the bow 102 as depicted by numerals 134 and 138, and the stern 104 as depicted by numerals 122 and 126.

In this embodiment, the vessel 100 is secured to pile 114 by attachment of line 116 spooled by the line retrieval device 110. The line retrieval device 110 is then operated as a spring line attachment to prevent rearward movement of the vessel during tidal change, wind or current movement. Similarly line retrieval apparatus 112 employs line 118 for attachment to pile 120 to prevent forward movement of the vessel, line 118 operating as an aft spring line. The stern 104 of the vessel includes a port side stern line retrieval apparatus 122 wherein line 124 crosses the center of the stern of the vessel for attachment to pile 120. Line 124 prevents the stern of the vessel from impacting the pier 126 making the arrangement suitable for higher winds without the need for additional morning lines. The stern mounted starboard side line retrieval apparatus 126 employs line 128 for attachment to pile 130. Line 128 operates to prevent the vessel from movement away from the pier thereby maintaining the walkway 132 in a fixed position for ease of entrance and exiting of the cockpit from the vessel. On the bow of the vessel a starboard line retrieval device 134 employs line 136 for attachment pile 114 preventing the bow of the vessel from impacting pier. Similarly the port side line retrieval device 138 on the bow 102 employs line 140 for attachment to pile 142. This line attachment prevents the vessel from an outward movement just to maintain a close proximity to the pier 126.

In this example, piles 130 and 142 are used for docking lines, however, no piles are available for positioning the vessel apart from the pier. For this reason, the vessel is spaced from the pier by the use of fenders 146 and 150 which provide a cushion from the pier 126. Fenders are commonly found on the vessel so as to accommodate oversized piles or lack thereof. In this illustration a fender 146 is attached to the line retrieval device 148 wherein the operator can deploy or retrieve line as necessary so as to position the fender 146 in a proper location. Similarly fender 150 is attached to line retrieval device 152 allowing the operator to change fender location from the bridge. In this manner as the vessel 100 is brought along side the pier 126 wherein the operator is able to instantly adjust the positioning of the fenders should in an impact with the pier be inevitable thereby protecting the finish of the vessel. It is noted that the docking apparatus is not specifically designed as a fender holder, it operates only as an ancillary benefit to further allow the vessel operator to maneuver the vessel in close quarters with minimal crew members.

Figure 4:
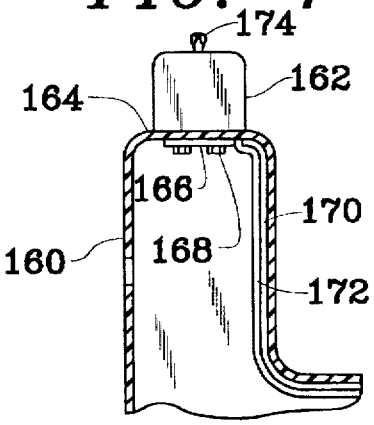
FIG. 4 is a cross-sectional side view of a bulwark showing the instant invention mounted along the top portion of the bulwark.
Figure 5:
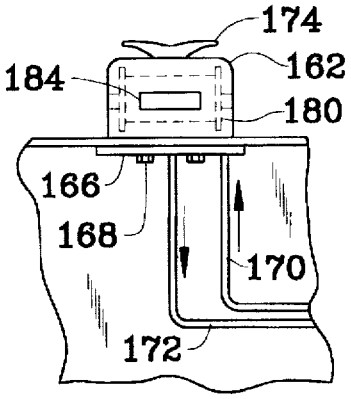
FIG. 5 is a front view of FIG. 4.
Figure 6:
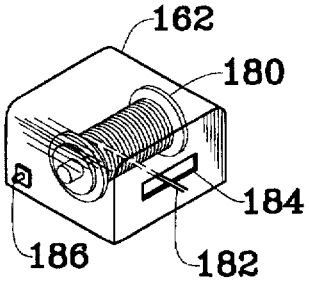
FIG. 6 is a perspective view of the line retrieval device for the docking apparatus.

Now referring to FIG. 4, shown is a bulwark 160 having line retrieval device 162 positioned along an upper surface 164. The line retrieval device 162 is an individually housed winch that is actuated by a central pump and valve manifold. The winch is bidirectional and free wheeling employing a motor allowing variable speed and power. The line retrieval device 162 is secured to the bulwark 164 by placement of a reinforcement plate 166 beneath bulwark to distribute the load with mounting bolts 168 maintaining the line retrieval device 162 in a secure position. The hydraulic fluid of the instant invention is run through piping system 170 as a pressurized feed and 172 return flow line, or in the reverse direction which is dependant upon the placement of the directional solenoid valves.

The tubing maybe metal or preferably hydraulic hose that is in impervious to salt water corrosion. A cleat 174 is located on the upper wall of the line retrieval device wherein the line structure is of a sufficient rigidity to withstand cleat attachment with the same strength had the cleat been secured directly to the vessel.

A spool 180 is positioned inside the structure which allows for line 182 movement through aperture 184 as needed. The line includes a sealing end cap formed as a monkey fist, as described later in this specification, which is operatively associated with the aperture to prevent the elements from entering the structure while the line is in a storage position. Drainage of the line retrieval structure is possible through apertures located along a bottom surface, not shown, allowing drainage and ventilation for drying. A remote actuator 186 allows for micro adjustment of the line 182 directly from the line retrieval device 162 so as to allow the operator of the vessel to make minute line adjustments without the need for returning to the centralized control panel to be mounted on the bridge.

The preferred speed for a winch is thirty feet per minute (30 fpm) with approximately one thousand pounds of tension. The winch housing mount is rated for five thousand pounds and hold at least twenty five feet of docking line. Each winch includes a limiting switch to disengage the winch once the line is fully retrieved.

Figure 7:
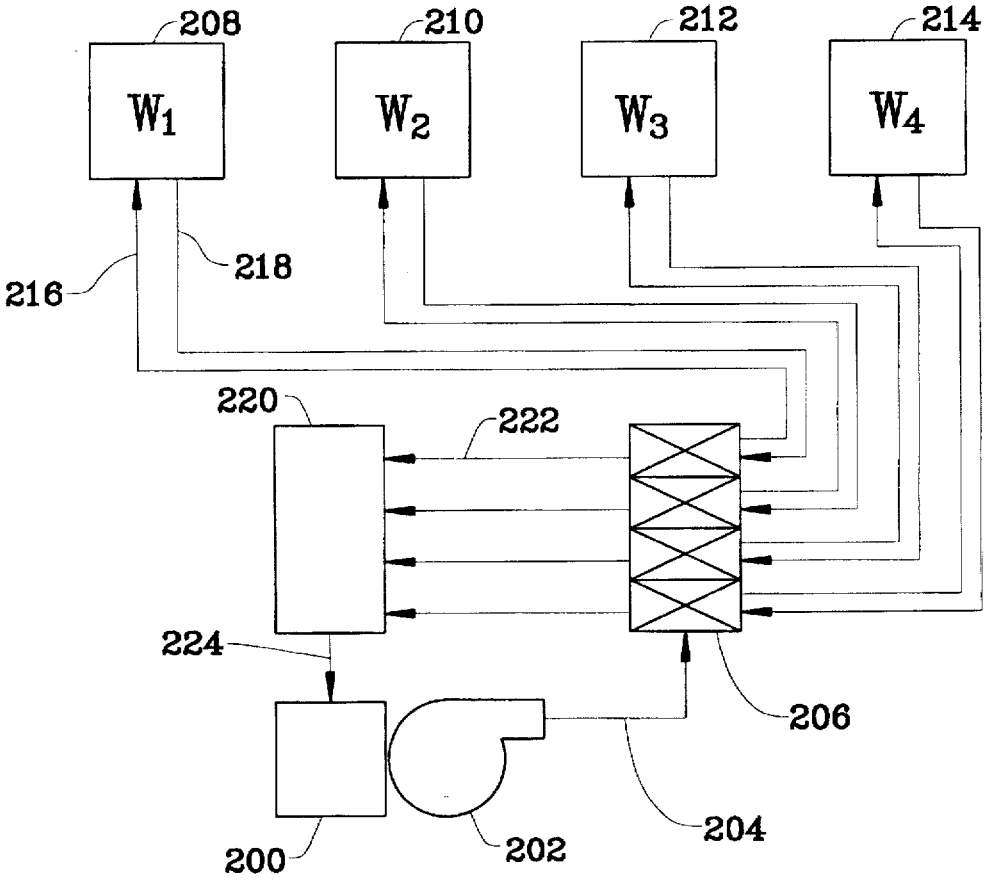
FIG. 7 is a hydraulic schematic of the docking apparatus.

Now referring to FIG. 7, set forth is a hydraulic schematic which depicts a fluid reservoir 200 which is used by a pressurizing pump 202 which pressurized hydraulic fluid through coupling line 204 to a solenoid valve arrangement 206. The solenoid valve arrangement allows for control of line retrieval device 208, 210, 212 and 214. Each line retrieval system having an internal spool which is operated by pressurized fluid and allows movement of the spool for purposes of line retrieval based upon the amount of fluid and pressure delivered to the individual line retrieval device. By way of illustration, line retrieval device 208 has a pressurized inlet 216 and low pressure outlet 218 which may be short circuited allowing melt fluid flow to the device allowing the spool to free-wheel which allows for manual line deployment. The pressurized inlet and low pressure outlet can be reversed for a controlled spooling of the line. The remaining line retrieval devices include pressurized and return line, all of which are operated by the solenoid valve system 206. Return fluid is connected to a manifold 220 to tubing 222 allowing return to holding reservoir 200 to coupling pipe 224.

Figure 8:
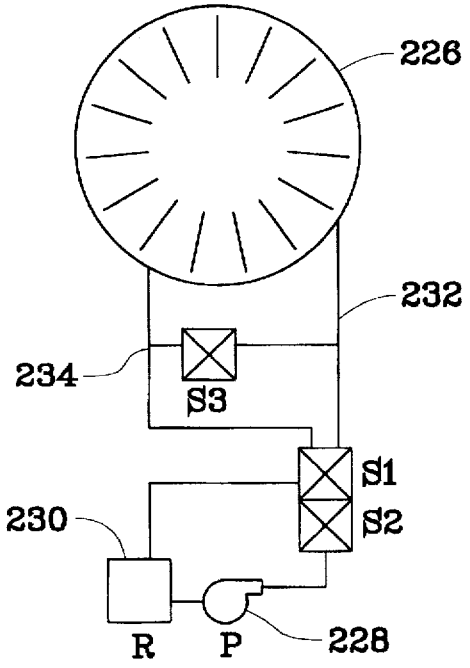
FIG. 8 is a pictorial hydraulic schematic of a line retrieval device of the docking apparatus.

FIG. 8 illustrates a pictorial of a hydraulic spool 226 which is made operational by a series of solenoid valves. In this illustration, pump 228 obtains fluid from the reservoir 230 and is delivered to solenoid $S_1$. $S_1$ is a directional solenoid wherein fluid flows through the pressure line 232 to spool 226 allowing rotation with return fluid flowing through return line 234 and back to reservoir 230. For a reverse flow, pump 228 obtains fluid from the reservoir 230 and is delivered to solenoid $S_1$. $S_1$ is a directional solenoid wherein fluid flows through the pressure line 234 to spool 226 allowing rotation with return fluid flowing through return line 232 and back to reservoir 230.

The spool may be made variable speeds by varying the pressure of the pump, output pressure, or providing dual speed wherein solenoid valve $S_2$ may open a larger orifice to provide additional fluid flow and pressure through pressure lines 232 and 234 so as to cause rotation of the spool at a higher RPM. When solenoid valves $S_2$ and $S_3$ are closed, the veins of the spool are deadheaded causing the spool to be situated in a locked position. The closure of solenoid $S_2$ and the opening of solenoid valve $S_3$ allows the spool 226 to free-wheel allowing manual deployment of the line.

Figure 9:
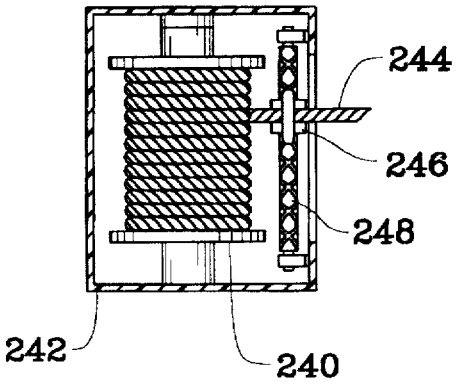
FIG. 9 is a cross-sectional top view of the docking apparatus depicted in FIG. 6.
Figure 10:
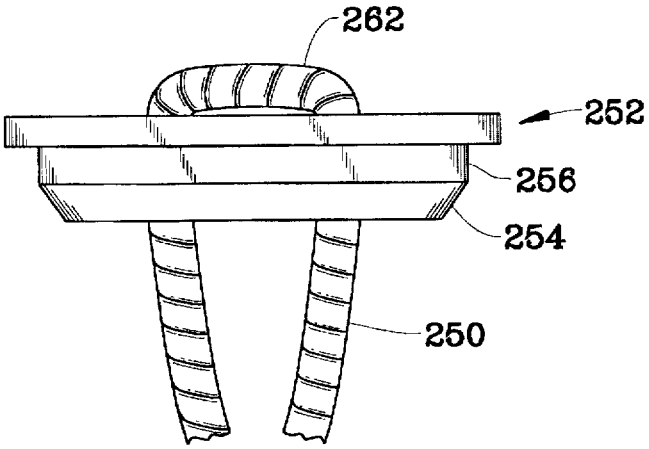
FIG. 10 is a plain view of an end cover of the instant invention attached to a line.
Figure 11:
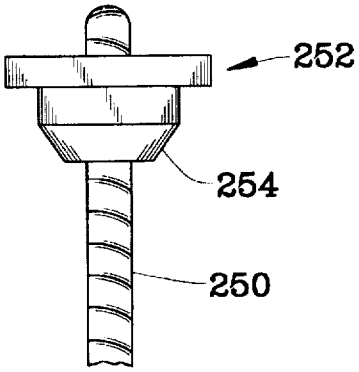
FIG. 11 is a side view of an end cover.

FIG. 9 illustrates a spool 240 placed within line retrieval device housing structure 242 wherein the spool is secured to the sidewalls of the structure wherein line 244 is wrapped around the spool and delivered through a line feeder 246. The line feeder sequentially wraps the line during the retraction procedure as provided by feeder bar 248 which moves along the width of the housing in relation to the rotation of the spool for proper positioning of the line in relation to the spool. The purpose of the line handler is to provide a smaller housing structure that feasible by allowing the line to wrap sequential layers thereby providing efficiency in line placement. The hydraulic motor, not shown, may alternatively replaced by an electric motor or even a pneumatic system. However, it is believed that the hydraulic system provides the greatest efficiency by eliminating the need for multiple electric motors in a docking system having more than two line retrieval devices. In addition, the hydraulic system does not corrode as it is internally sealed provides a non-compressible fluid that allows the spool to be locked in a position when the hydraulic fluid is stagnated.

FIGS. 10 through 13 depict the line attachment wherein a partial loop 250 of a line includes end cover 252 secured to the line for purposes of added weight for tossing, as well as sealing the housing 260 to prevent water from contacting the spool. The end cover 252 includes an aperture which allows for insertion of the line wherein the line can then be rebraided so as to form a continuous loop or the line can be molded into the end cover. The end cap 252 is operatively associated with an aperture 258 of housing structure 260 allowing for the sealing of the structure 260 when the line is fully retracted. The end cap 252 has a chamfered surface 254 for self positioning of the end cover 252 to the aperture wherein said surface 256 provides a seal to aperture 258.

Figure 12:
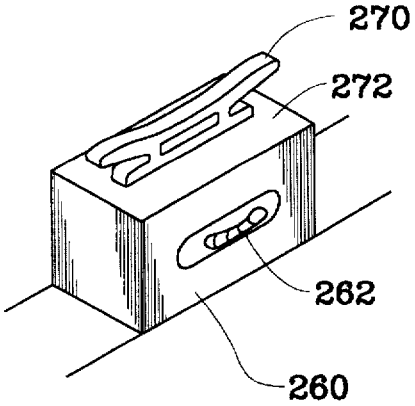
FIG. 12 is a perspective view of a line retrieval device with an end cover shown in a retracted position.
Figure 13:
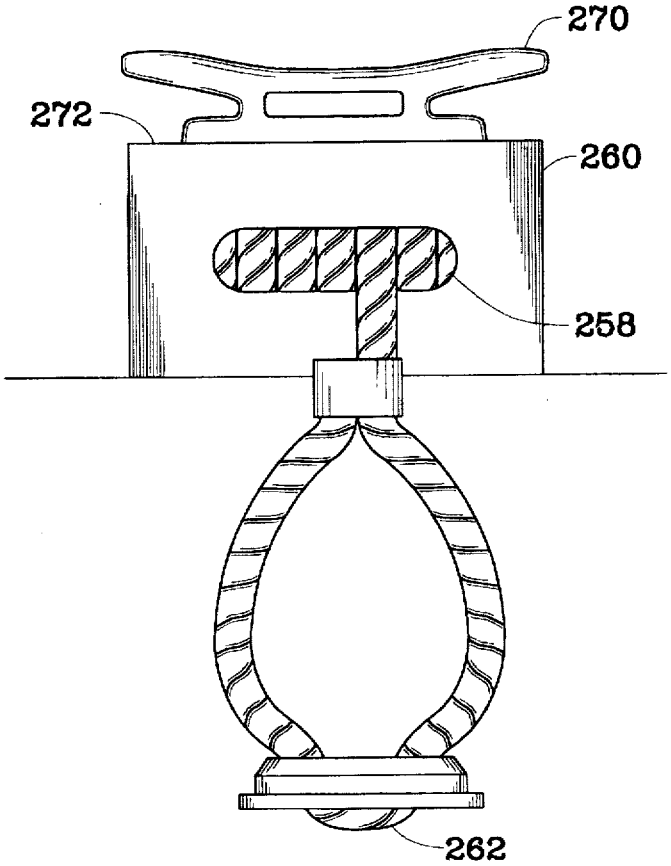
FIG. 13 is a front view of a line retrieval device with an end cover shown attached to a line in a partially spool out position.

During line 250 deployment, the end cap is constructed of a plastic or non-marring rubber, which allows the line to be tossed by providing a weighted section. The end cap 252 includes a protrusion 262 of the line 250 which allows for ease of grasping the end cap 252 when the end cap is in a stored position as depicted by FIG. 12. The housing structure 260 may include a cleat 270 mounted along an upper surface 272 of the housing which allows the housing structure 260 to be bolted in the same position as an existing cleat so as to eliminate the consumption of additional deck space.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. A docking apparatus for temporarily securing a vessel to a pier or pile, said docking apparatus comprising:

at least two housings secured to said vessel, each said housing having an elongated aperture for placement of a docking line therethrough;

a spool rotatable secured inside each said structure;

a docking line having a proximal end coupled to said spool and a distal end available for coupling to said pier or pile, said docking line stored in said housing by rotation of said spool causing said line to wrap around said spool;

a weighted end cover means secured to said distal end of said docking line, said end cover sized to seal said elongated aperture when said docking line is placed around said spool;

means for directional alignment of said docking line to said spool;

a hydraulic means fluidly coupled to said rotatable spool;

remote means for controlling the amount of fluid directed to said rotatable hydraulic spool allowing an operator of said vessel to control the rotational speed thereof;

wherein said distal end of said docking line is free wheeled from said spool for coupling to said pier or pile whereby said docking line is retracted into said retrieval structure at a speed dependant upon the amount of fluid flow to said spool allowing vessel movement to the pier at a rate controllable by the operator of said vessel.

2. The docking apparatus according to claim 1 wherein said housing includes mounting means for securing said housing to said vessel.

3. The docking apparatus according to claim 1 wherein an upper surface of said housing is available for securing a tie-down cleat thereto.

4. The docking apparatus according to claim 1 wherein said hydraulic system is further defined as: a hydraulic pump having a fluid reservoir, said pump having a pressure line coupled to said spool providing rotation of said spool and a return line to said reservoir for recycling of said fluid; a first solenoid means for throttling said fluid pressurized by said pump; and a second solenoid means for coupling said pressurized line with said return line allowing said spool to free wheel.

5. The docking apparatus according to claim 1 wherein said end cover is formed from a white rubber composite.

6. The docking apparatus according to claim 1 wherein said end cover includes a hand grip formed integral herein.

7. The docking apparatus according to claim 1 wherein said means for directional alignment is defined as a moving aperture having a drive mechanism responsive to line retraction, said drive mechanism allowing for the uniform wrapping of said docking line to said spool upon retraction of said line.

8. The docking apparatus according to claim 1 wherein said remote means is further defined as a remotely mounted switch for operation of solenoid valves allowing directional control of said docking line.

9. The docking apparatus according to claim 1 wherein said vessel has a bow, a stern, a port side and a starboard side; wherein said retrieval structures are mounted to said port side of said vessel.

10. The docking apparatus according to claim 9 wherein said retrieval structures are mounted to said starboard side of said vessel.

11. The docking apparatus according to claim 1 wherein said retrieval structures are mounted to said bow and said stern of said vessel.

12. A docking apparatus for temporarily securing a vessel to a pier or pile, said docking apparatus comprising:

at least two line retrieval structures secured to said vessel, said line retrieval structures each having a spool rotatable secured inside said structure and a elongated aperture extending through said structure allowing access to said spool;

a docking line having a proximal end coupled to said spool and a distal end available for coupling to said pier or pile, said docking line stored in said retrieval structure by rotation of said spool causing said line to wrap around said spool;

means for directional alignment of said docking line to said spool;

a hydraulic pump having a fluid reservoir with a pressure line coupled to said spool providing rotation of said spool and a return line to said reservoir for recycling of said fluid;

a first solenoid means for throttling said fluid pressurized by said pump;

a second solenoid means for coupling said pressurized line with said return line allowing said spool to free wheel;

remote means for controlling the amount of fluid directed to said rotatable hydraulic spool allowing an operator of vessel to control the rotational speed thereof; and limiting switch means to disengage said first solenoid when a line is fully retrieved;

wherein said distal end of said docking line is free wheeled from said spool for coupling to said pier or pile whereby said docking line is retracted into said retrieval structure at a speed dependant upon the amount of fluid flow to said spool allowing vessel movement the pier at a rate controllable by the operator of said vessel.

13. The docking apparatus according to claim 12 wherein said docking line includes an end cover means sized to seal said aperture when said docking line is positioned around said spool.

14. The docking apparatus according to claim 13 wherein said end cover is weighted.

15. The docking apparatus according to claim 13 wherein said end cover is formed from a white rubber composite.

16. The docking apparatus according to claim 13 wherein said end cover includes a hand grip formed integral therein.

17. The docking apparatus according to claim 13 wherein said remote means is further defined as a remotely mounted switch for operation of solenoid valves allowing directional control of said docking line.

* * * * *